United States Patent [19]

Scholz et al.

[11] Patent Number: 4,827,863

[45] Date of Patent: May 9, 1989

[54] PLOW ANCHOR FOR MARINE USE

[75] Inventors: Max Scholz, Newburyport; Scott Batchelder, Newbury; Robert Dowding, Natick, all of Mass.

[73] Assignee: Rule Industries, Inc., Gloucester, Mass.

[21] Appl. No.: 94,117

[22] Filed: Sep. 8, 1987

[51] Int. Cl.[4] ..... B03B 21/32

[52] U.S. Cl. ..... 114/301; 114/304

[58] Field of Search ..... 114/294, 295, 304, 308, 114/301

[56] References Cited

U.S. PATENT DOCUMENTS

| | | | |
|---|---|---|---|
| 1,974,933 | 9/1934 | Taylor . | |
| 2,249,546 | 7/1941 | Danforth . | |
| 2,492,202 | 6/1946 | Norton . | |
| 2,674,969 | 4/1954 | Danforth | 114/301 |
| 2,738,750 | 3/1956 | Vorenkamp | 114/301 |
| 2,743,695 | 5/1956 | Bowman | 114/301 |
| 3,716,012 | 2/1973 | Wright . | |
| 3,749,044 | 7/1973 | Klaren | 114/301 |
| 4,397,256 | 8/1983 | Bruce | 114/301 |
| 4,433,635 | 2/1984 | Takahashi . | |
| 4,469,042 | 9/1984 | Ogg . | |
| 4,559,893 | 12/1985 | Ogg . | |
| 4,676,184 | 6/1987 | Ogg | 114/294 |

OTHER PUBLICATIONS

Product literature by Rule Industries.

Product literature by CQR.

Lucking, D. F., "The Experimental Development of Anchors for Seaplanes", Trans. Inst. Naval Architects, vol. 78, 1936.

LeLievre B., et al., "Holding Capacity of Marine Anchors in Sand" Report.

Danforth, R. S., "Cables and Their Effect on Anchor Loads", Society of Naval Architects and Marine Engineers, San Francisco Meeting, Apr. 13, 1945, Summary of Paper.

Leahy, William H, et al., "Determing Anchor Holding Power from Model Tests", pp. 105–120.

The Bruce Anchors Product Literature.

*Primary Examiner*—Sherman D. Basinger

*Assistant Examiner*—Stephen P. Avila

[57] ABSTRACT

An improved anchor having a shank and, pivotally connected thereto, a head consisting of a generally flat, arcuate body, a pair of flukes attached to the body and extending laterally from a plane of the shank and body, and a bottom penetrating nose portion, has the further features of the body and shank having a narrowed lead edge and the material of the shank and body being disposed in rectangular cross-sections having substantial ratios of height to thickness. The shank and body of the anchor thereby have a thin lead edge profile to facilitate passage of the anchor through a bottom surface to burrow into the bottom, and the shank has broad side surfaces to resist anchor dislodgement under side forces.

4 Claims, 2 Drawing Sheets

PLOW ANCHOR FOR MARINE USE

The invention relates to anchors for marine use, and in particular to plow anchors of the type capable of setting on varied bottoms by burying, rather than by hooking as with other forms of anchors.

SUMMARY OF THE INVENTION

The invention relates to an anchor comprising a shank and, pivotally connected thereto, a head portion comprising: a generally flat, arcuate body, a pair of flukes attached to the body and extending laterally from a plane of the shank and body, and a bottom penetrating nose portion.

According to the invention, the body and the shank define a narrowed lead edge and the material of the body and the shank are disposed in cross-sections having substantial ratios of height of thickness, the shank and body of the anchor thereby having a thin lead edge profile to facilitate passage of the anchor through a bottom surface to burrow into the bottom, and the shank having broad side surfaces adapted to resist anchor dislodgement under side forces.

In preferred emnbodiments, the height to thickness ratio of the shank is of the order of at least 3 to 1, and preferably is of the order of about 6 to 1; the height to thickness ratio of the body is of the order of at least about 5 to 1, and preferably is of the order of about 8 to 1; and the shank and body are joined in a hinge joint having a primary center hinge tube disposed between a pair of secondary hinge tubes, the shank defining the primary center hinge tube and the hinge joint having a narrow profile to further facilitate passage of the anchor through the bottom surface to burrow into the bottom.

Other features and advantages of the invention will be apparent from the following description of a presently preferred embodiment, and from the claims.

PREFERRED EMBODIMENT

We first briefly describe the drawings.

FIG. 1 is a side view of a plow anchor of the invention;

FIGS. 2 and 3 are sectional views of anchor shank and body taken at the lines 2—2 and 3—3, respectively;

Figure 1:
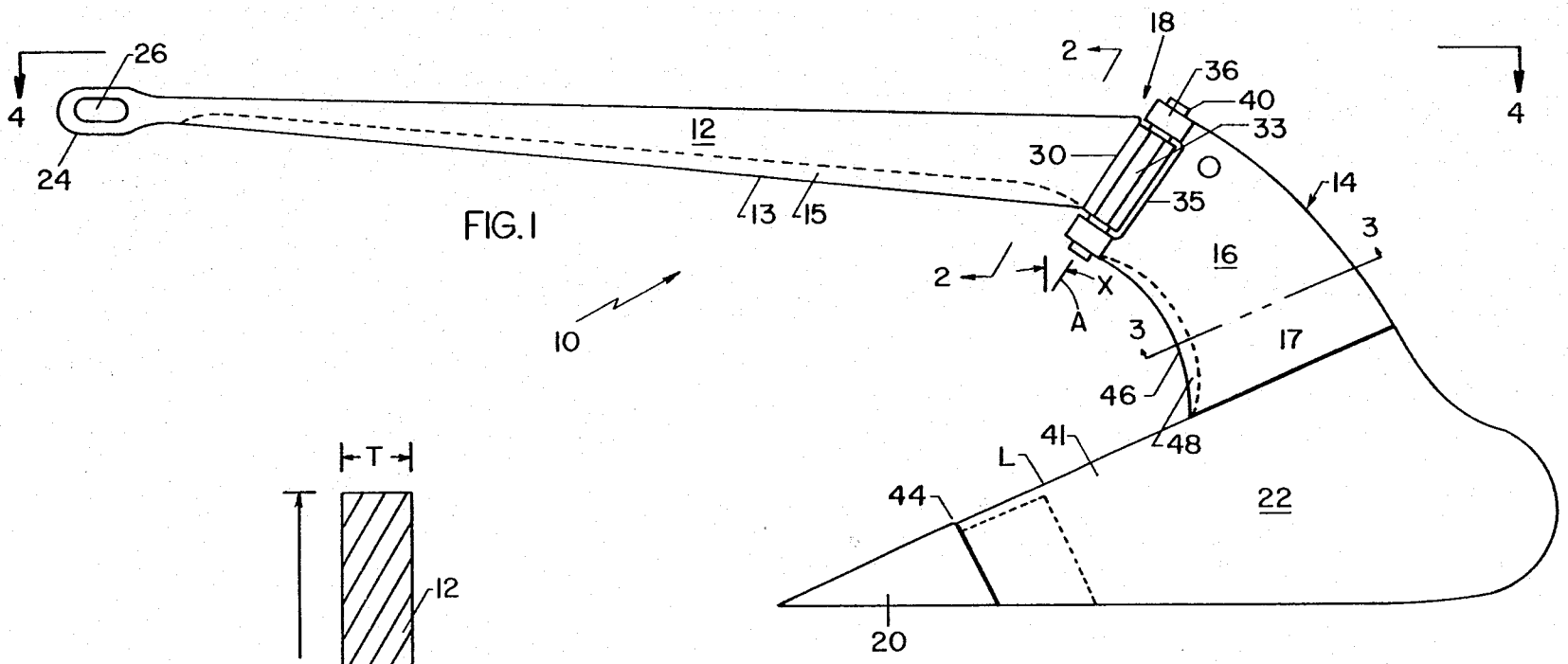

Referring to FIGS. 1, anchor 10 of the invention consists of a shank 12, and a head portion 14 consisting of body 16 connected to the shank at hinge joint 18, an anchor nose 20, and flukes or plow 22 disposed to extend laterally from the vertical plane, P, of the shank and body.

Figure 2:
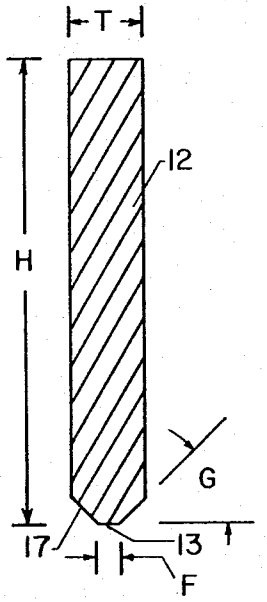
Figure 5:
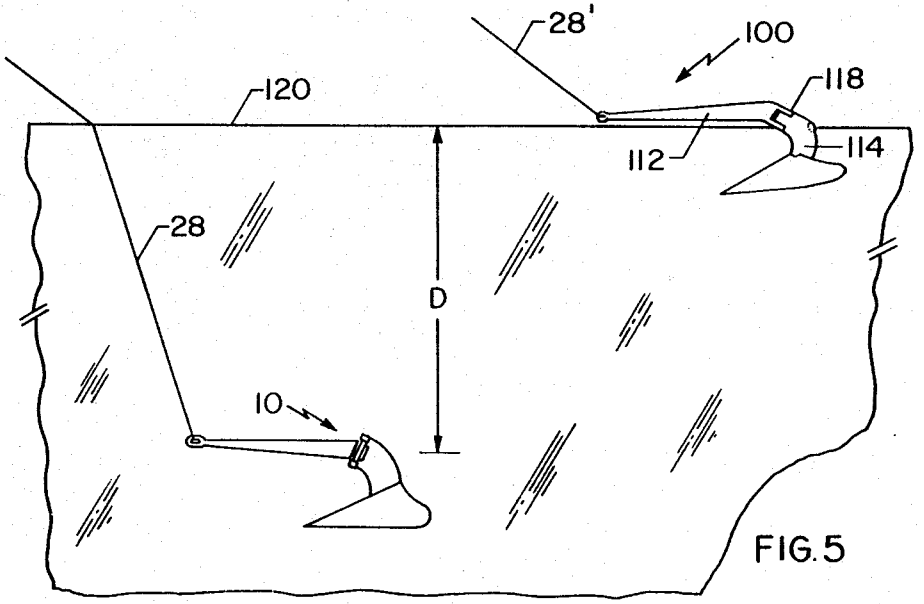
FIG. 5 is a somewhat diagrammatic side view of the anchor of FIG. 1 and a prior art plow anchor set, e.g., in an muddy bottom.

Shank 12, formed of heat treated spring steel, at its outer end 24 defines an eyelet 26 for receiving the terminal end of a rode, e.g., rope 28 (FIG. 5). The inner end 30 of shank 12 terminates in hinge tube 32, e.g., of 4130 steel alloy, welded to the shank. The tube is disposed with its axis, A, generally in the plane of the shank and body, and lies at an angle, X, e.g., about 34°, to vertical. Stops 33 extend radially from the hinge pin to engage upon surfaces 35 of body to limit the range of pivoting of shank 12, e.g., to an included angle of 90°. In cross-section (FIG. 2), the body of the shank is generally rectangular and tapers from adjacent the eyelet at the outer end 24, where the height, H, to thickness, T, ratio is nearly 1 to 1, toward the inner end 30, where the height to thickness ratio is substantial, e.g., at least 3 to 1 and preferably about 6 to 1, or about 30 inches in height and 0.5 inch thick. The lead edge 13 of shank 12 is bevelled in region 15 to a width, F, e.g., about ⅛ inch, with side surfaces 17 at angle G, e.g., about 45°. As a result, the shank has a narrow profile in the plane of the shank and body to facilitate bottom penetration of the anchor for improved holding power, and also broad side surfaces to engage upon the mud or other bottom material to resist dislodgement of the anchor under side forces.

The body 16, e.g., formed of a low carbon steel plate ⅝ inch thick, consists of an upper end portion 34 terminating in a pair of hinge tubes 36, 38, also of 4130 steel alloy and joined to the body by welding. The hinge tubes 36, 38 are aligned with axis A, and hinge pin 40 extends through tubes 32, 36, 38 to pivotally join shank 12 to anchor head portion 14. The hinge tubes and adjoining welded segments of the shank and body are also of narrow profile.

Figure 3:
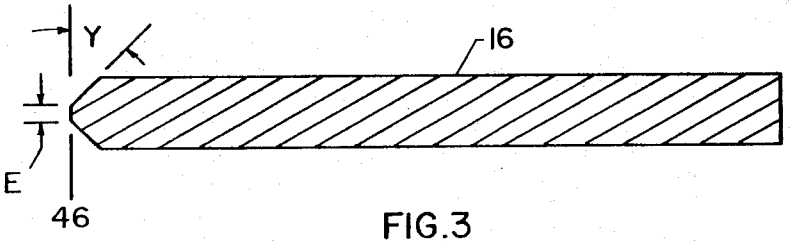

The lower end portion of body 16 is joined to plow 22, as described below. Referring to FIG. 3, the lead edge 46 of body 16 is also bevelled in region 48 to width, E, e.g., about ⅛ inch, with side surfaces 47 at angle Y, e.g., about 46°, to provide a narrow leading edge profile to further facilitate penetration of the anchor.

Figure 4:
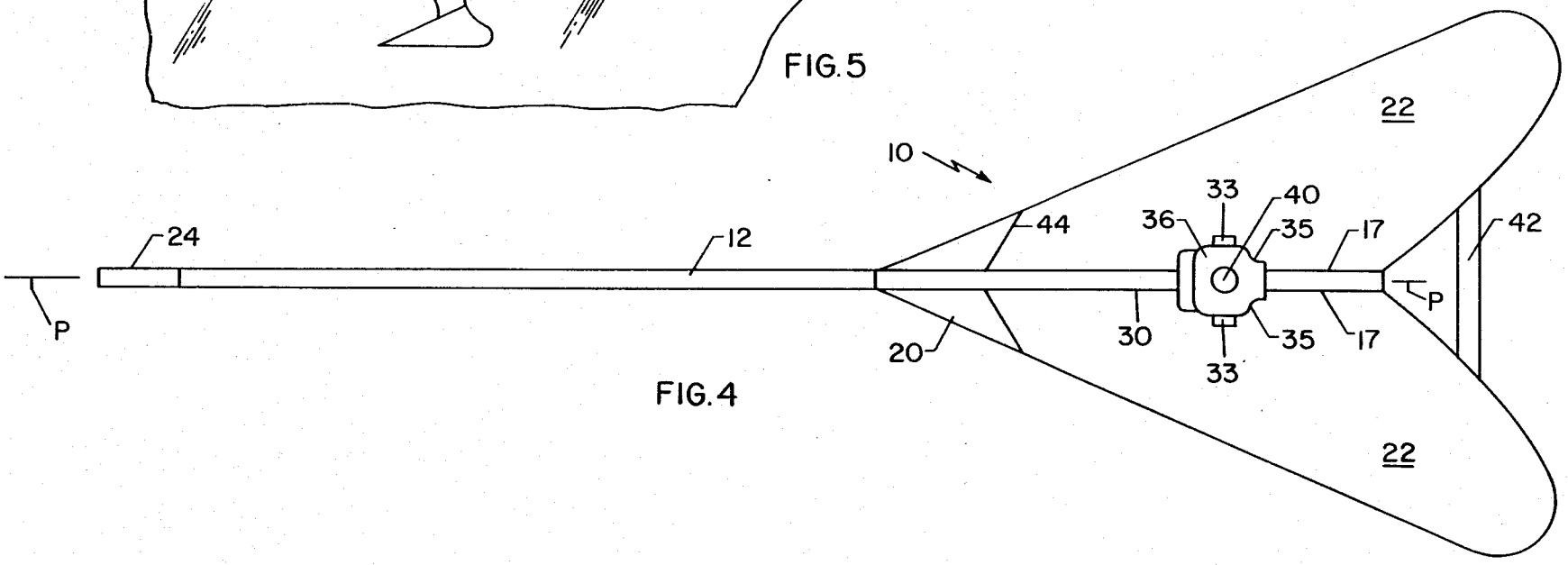
FIG. 4 is a plan view of the anchor taken on the line 4—4 of FIG. 1.

Flukes 22, formed, eg., of 3/16 inch thick low carbon steel, consist of a generally heart-shape plate formed upon the line of symmetry, and affixed to body 16, e.g., by welding along line 17. Viewed from above (FIG. 4), the lobes of the flukes extend outwardly to define a broad, generally upwardly facing surface for good bottom holding characteristics. Strut 42 (FIG. 4), e.g., ⅝ inch diameter low carbon steel reinforcing rod, extends between the flukes for structural support.

The anchor 10 terminates in anchor nose 20, e.g., cast low carbon steel, joined to the plow at the forward edge of the flukes, with the joint 44 ground smooth to further improve bottom penetration.

In order to test the performance of the anchor of the invention, a series of anchor tests were conducted to compare the improved plow anchor of the invention to a comparable anchor of the prior art design (C.Q.R. anchor, manufactured by Simpson-Lawrence Ltd.). The results are described in the chart below.

These tests were conducted using a 42 foot, twin engine Eldridge McGinnis design, Grand Banks trawler yacht of heavy displacement. The tests were conducted by backing down on a set anchor and measuring the holding force using a BLM strain gage (10,000 lb. capacity) mounted on a calibrated link in the bow of the vessel. This force measurement was recorded using a Honeywell strip chart recorder.

Three different types of bottom were used:

Bottom A—Thin soupy mud, depth 10 feet

Bottom B—Medium Mud, depth 11 feet

Bottom C—Hard sand, depth 20 feet

Various lengths of chain and cable were inserted into the anchor rode to determine the correctness of the published data and advice in literature provided by Rule Industries, Inc., assignee of this application. In all cases the chain in the anchor rode improved anchor performance and, for some type anchors, was essential for achieving design holding power.

When anchoring in hard sand, the maximum holding force was not measured at values over 4000 lbs. as gear would fail and such high holding forces are not meaningful. Almost any anchor will give excellent holding force in hard sand, once it begins to penetrate the surface.

Referring to the chart below, anchors of equivalent size are compared. As may be seen, it was found that the plow anchor of the invention was superior to other prior art plow anchors tested.

| "Deepset" TM Plow Anchor of the Invention Model-Wt. | BOTTOM TYPES A Maximum Holding Force (lbs) Deep set/CQR | B Deep set/CQR | C Deep set/CQR | Comparable C-Q-R Plow Anchor Model |
|---|---|---|---|---|
| P700-15 lbs | 320/150 | 700/285 | 4250/900 | 25 |
| P1000-19 lbs | 440/450 | 950/460 | 4000/950 | 35 |
| P1500-29 lbs | 494/260 | 1500/560 | 4000/1300 | 45 |
| P1800-35 lbs | 520/300 | 1900/600 | 4000/2200 | 60 |

Referring to FIG. 5, it has been found that prior art plow anchors 100, e.g., of the CQR type, due to the massive shank 112, hinge 118 and body 114 construction, have low height-to-thickness ratios, and typically penetrate the bottom surface 120 only to the point of engagement of the shank upon surface 120. In contrast, the plow anchor of the invention, due to the narrowed lead edge of the shank and body, and the substantial height-to-thickness ratios of these components, and also of the hinge, is able to pass through the bottom surface and burrow into the bottom to depth, D, e.g., in certain bottom types to 6 feet or more. Marked increase in maximum holding force for all bottom types is thus provided.

What is claimed is:

1. In an anchor comprising an elongated shank and, pivotally connected thereto, a head portion comprising:

a generally flat, arcuate body portion, a pair of flukes attached to said body portion and extending laterally from a plane of said shank and said body, and a bottom penetrating nose portion, the improvement wherein said body portion and said shank define a narrowed lead edge and the material of the body of said body portion and the material of the body of said shank are disposed in cross-sections having substantial ratios of height to thickness, said shank having a height to thickness ratio of at least about 3 to 1 and said body portion having a height to thickness ratio of at least about 5 to 1, the shank and body of said anchor thereby having a thin lead edge and body profile to facilitate passage of said anchor through a bottom surface to burrow into said bottom, said shank having broad side surfaces adapted to resist dislodgement of said anchor under side forces, and said shank and said head portion jointed at a hinge axis disposed in said plane of said shank and said body portion and at an angle traverse to the axis of said shank.

2. The anchor of claim 1 wherein said shank ratio is of the order of about 6 to 1.

3. The anchor of claim 1 wherein said body portion ratio is of the order of about 8 to 1.

4. The anchor of claim 1 wherein a hinge joint disposed upon said hinge axis has a primary center hinge tube disposed between a pair of secondary hinge tubes, said shank defining said primary center hinge tube, and said hinge joint having a narrow profile to further facilitate passage of said anchor through said bottom surface to burrow into said bottom.

* * * * *

UNITED STATES PATENT AND TRADEMARK OFFICE

CERTIFICATE OF CORRECTION

PATENT NO. : 4,827,863

DATED : May 9, 1989

INVENTOR(S) : Max Scholz et al.

It is certified that error appears in the above-identified patent and that said Letters Patent is hereby corrected as shown below:

Col. 1, line 19, "of thickness" should be --to thickness--.

Col. 1, line 25, "emnbodiments" should be --embodiments--.

Col. 1, line 51, "FIGS. 1" should be --FIG. 1--.

Signed and Sealed this

Seventh Day of September, 1993

Bruce Lehman

*Attest:*

BRUCE LEHMAN

*Attesting Officer*

*Commissioner of Patents and Trademarks*